US005939970A

United States Patent [19]

Tsuji et al.

[11] Patent Number: 5,939,970

[45] Date of Patent: Aug. 17, 1999

[54] THERMALLY RESPONSIVE SWITCH

[75] Inventors: Takao Tsuji; Hideki Koseki, both of Aichi, Japan

[73] Assignee: Ubukata Industries, Co., Ltd, Aichi, Japan

[21] Appl. No.: 09/187,480

[22] Filed: Nov. 6, 1998

[51] Int. Cl.[6] ..... H01H 37/74; H01H 61/00; H01H 37/04

[52] U.S. Cl. ..... 337/343; 337/89; 337/349; 337/298; 337/327

[58] Field of Search ..... 337/342, 343, 337/298, 333, 347, 348, 349, 354, 368, 53

[56] References Cited

U.S. PATENT DOCUMENTS

| | | | |
|---|---|---|---|
| 4,317,097 | 2/1982 | Hofsass | 337/89 |
| 4,319,214 | 3/1982 | Giver | 337/343 |
| 4,517,541 | 5/1985 | Ubukata et al. | 337/89 |
| 4,894,634 | 1/1990 | Nezuka et al. | 337/343 |
| 4,914,414 | 4/1990 | Ubukata et al. | 337/368 |
| 5,337,036 | 8/1994 | Kuczynski | 337/343 |
| 5,428,336 | 6/1995 | Smith et al. | 337/365 |

FOREIGN PATENT DOCUMENTS

| | | | |
|---|---|---|---|
| 55-148331 | 11/1980 | Japan | H01H 37/54 |
| 1-302628 | 12/1989 | Japan | H01H 37/54 |

*Primary Examiner*—Leo P. Picard
*Assistant Examiner*—Anatoly Vortman
*Attorney, Agent, or Firm*—Foley & Lardner

[57] ABSTRACT

A thermally responsive switch includes a metal housing formed into the shape of a bottomed cylinder and having an open end, a header plate including a metal plate having a through hole and an electrically conductive lead terminal pin inserted through and airtightly fixed in the hole in an electrically insulated state, the header plate being airtightly fixed to the open end of the housing so that the housing and the header plate constitute a hermetic housing, a thermally responsive element formed into the shape of a shallow dish and having a generally central through hole, a fixed contact section provided on a portion of the lead terminal pin located in the hermetic housing, a movable plate support secured to the metal plate of the header plate located in the hermetic housing, a movable plate formed of a leaf spring-shaped conductive metal plate and having one end secured to the movable plate support, and a movable contact fixed to the other end side of the movable plate.

20 Claims, 9 Drawing Sheets

THERMALLY RESPONSIVE SWITCH

BACKGROUND OF THE INVENTION

1. Field of the Invention

This invention relates to a thermally responsive switch of the hermetic type in which no current flows into a thermally responsive element such as a bimetal and which is substantially responsive to an ambient temperature.

2. Description of the Prior Art

Various types of protective switches have conventionally been used to protect motors for air conditioners and refrigerators against an overheat or overcurrent in abnormal conditions. In the conventional protective switches, an operating current of the motor is caused to flow into the thermally responsive element so that the element is responsive to an overheated condition in a compressor or an overcurrent in the motor. The thermally responsive element reverses its curvature to thereby cut off the operating current when the ambient temperature or the current value is abnormally increased.

Inverter-controlled motors have recently been used widely since these motors are readily and efficiently controlled minutely. However, the inverter-controlled motors cannot sufficiently be protected by the conventional protective switches for the following reason. An operating current is normally maintained in a predetermined range in conventional motors. The protective switch is adjusted not to operate in response to the motor operating current value and to operate in response to an overcurrent resulting from an abnormal condition such as a locked rotor condition. On the other hand, the operating current is varied according to a load even in the normal operation in the inverter-controlled motors. Accordingly, there is a possibility of deficiency of accuracy in a protecting characteristic when the protective switch provided for the inverter-controlled motor is designed to execute a protecting operation by utilizing the heating of the thermally responsive element subject to the motor operating current as in the conventional protective switches. In view of this problem, the protective switch for the inverter-controlled motor needs to be a thermally responsive switch of the type in which the motor operating current is not substantially caused to flow into the thermally responsive element.

Various types of thermally responsive switches have been proposed as the above-described type for the inverter-controlled motors. In many of the proposed thermally responsive switches, however, a relatively large base made of an insulating material such as resin is required for a thermally responsive element for driving a movable contact to be disposed thereon. The base prevents the thermally responsive switch from being rendered small in size.

Japanese Examined Patent Publication No. 56-8456 (1981) discloses a thermometal cutout as an example of the proposed thermally responsive switches as described above. In the disclosed thermometal cut-out, a bimetal is provided for engaging and disengaging a movable contact with and from a fixed contact, the movable contact being carried on a movable contact support plate. The thermometal cutout is arranged so that no current flows directly into the bimetal. The bimetal has a central insertion hole into which a support protrusion provided on the insulating base is fitted. The bimetal as a metal plate requires a relatively large insulator such as the insulating base for holding it in an insulated state.

A large insulator should not be enclosed in a casing of the thermally responsive switch when the casing is formed into a hermetic one. When the insulator is made of a resin, there is a possibility that the resin produces some gas in a long period of use of the thermally responsive switch. The gas would vary the composition of a filler gas filling the interior of the casing or cause chemical changes on surfaces of the contacts such that the conductivity between the contacts would be damaged. The above-mentioned filler gas is selected in view of the thermal conductivity etc. Furthermore, when ceramics are used as the insulator, there is a less possibility of production of a gas. However, it is difficult to fix the ceramic insulator to a metal component. In both cases of the resin and the ceramics, the heat capacity of the insulator is increased such that the responsibility of the thermally responsive switch is reduced.

Japanese Unexamined Patent Publication No. 1-302628 (1989) discloses a switch device having a reduced quantity of the insulator. In the disclosed switch device, a bimetal thermally responsive switch is enclosed in a metal accommodating section or casing. One end of a bimetal plate is fixed to a fixing portion of a movable contact support plate. The movable contact support plate is driven when the bimetal plate reverses its curvature in response to a predetermined temperature. However, an insulating plate reduces an assembling efficiency since it is interposed between a conductive portion such as a fixed contact and the metal casing. Furthermore, the metal casing is attached closely to the resin base and accordingly, the switch device is not formed into a hermetic structure. This Japanese publication shows a prior art construction in which an opening of the casing is closed by a resin so that a hermetic switch is provided. This rather simple hermetic structure cannot maintain a fixed composition of the filler gas for a long period.

Japanese Examined Patent Publication No. 2-21088 (1990) discloses a thermal protector with a completely hermetic structure. In the disclosed protector, a glass casing encloses a fixed electrode and a movable electrode both disposed in an opposite relation. The movable electrode is driven by a thermally responsive element. The thermally responsive element is welded at its movable end side to a metal elastic strip together with the contact. The other end of the thermally responsive element is supported when the element reverses its curvature. Upon the reversing of the thermally responsive element, its side carrying the movable contact is driven against a biasing force of the metal elastic strip, whereby the movable and fixed contacts are disengaged. Since the thermally responsive element is welded to the metal elastic strip in this thermal protector, reversing and returning temperatures of the thermally responsive element before the assembly thereof differ from those after the assembly. Furthermore, the glass casing is used so that a high level of gas tightness is achieved. However, when this thermal protector is used in an enclosed housing for an enclosed motor-driven compressor, the glass casing susceptible to breakage requires a special attention to the handling thereof.

Furthermore, the thermally responsive element is cantilevered in each of the above-described switch device and thermal protector. In this construction, stress of the thermally responsive element is increased when the contact pressure is increased. Consequently, application of the contact pressure varies the reversing and returning temperatures set in the state of a single unit of the thermally responsive element.

Japanese Unexamined Patent Publication No. 55-148331 (1980) discloses a thermal protection switch comprising a bimetal snap plate serving as a thermally responsive element and having a central through hole. A movable contact is inserted through the central hole of the bimetal snap plate and then fixed to a spring snap plate. Upon reverse of the bimetal snap plate, the movable contact is driven against a biasing force of the spring snap plate. Since the movable contact is disposed at the center of the thermally responsive element, a force resulting from the reverse is dispersed to a peripheral portion of the thermally responsive element. Consequently, the stress of the thermally responsive element can be reduced in this construction as compared with the cantilevered thermally responsive element.

In the above-described thermal protection switch, however, a casing body and a casing cover are fixed together by crimping with an insulator being interposed therebetween. This construction quite differs from the gas tight structure intended by the present invention. Furthermore, the inside of the casing cover serves as a fixed contact in the above-described thermal protection switch. Accordingly, even a slight deformation of the casing varies a force applied to the bimetal snap plate, resulting in variations in the reversing and returning temperatures of the bimetal snap plate.

As obvious from the foregoing, the conventionally proposed thermally responsive switches of the type in which no current flows into the thermally responsive element have found unsuitable for the use in the high-pressure atmosphere, for example, in the hermetic housing of the enclosed motor-driven compressor.

SUMMARY OF THE INVENTION

Therefore, an object of the present invention is to provide a thermally responsive switch which includes a housing with a high gas tightness and a high withstanding pressure and yet which has high thermal responsiveness and high productivity.

The present invention provides a thermally responsive switch comprising a housing made of a metal into the shape of a bottomed cylinder and having an open end, a header plate including a metal plate having a through hole and an electrically conductive lead terminal pin inserted through and airtightly fixed in the hole in an electrically insulated state, the header plate being airtightly fixed to the open end of the housing by means of welding or the like so that the housing and the header plate constitute a hermetic housing, a thermally responsive element formed into the shape of a shallow dish and having a generally central through hole, the thermally responsive element reversing a curvature thereof in response to a first predetermined temperature and re-reversing the curvature in response to a second predetermined temperature, a fixed contact section provided on a portion of the lead terminal pin located in the hermetic housing, a rigid movable plate support secured to a side of the metal plate of the header plate located in the hermetic housing, a flexible movable plate formed of a leaf spring-shaped conductive metal plate and having one end secured to the movable plate support, the movable plate exerting a biasing force normally pressing the other end thereof against the movable plate support side, and a movable contact fixed to the opposite end side of the movable plate, the movable contact engaging and disengaging from the fixed contact section when the thermally responsive element drives the movable plate.

According to the above-described construction, no current flows into the thermally responsive element. Consequently, even in the case where being used for equipment wherein the operating current varies, the thermally responsive switch can break an electric circuit without being adversely affected by the current variations when the ambient temperature reaches the first predetermined temperature. Furthermore, the above-described thermally responsive switch is suitable for the use in the high-pressure atmosphere such as in the hermetic housing of the enclosed motor-driven compressor. Additionally, all the parts composing a switch mechanism are assembled to the header plate. Positional relations between the parts and the operation of the switch mechanism can directly be confirmed before the airtight housing is constituted or the header plate is secured to the housing. Consequently,the assembly of the thermally responsive switch can be rendered easier.

In a preferred form, the thermally responsive element is connected to said opposite end side of the movable plate at a location of the through hole so as to be loosely fitted therewith, thereby being held. Since the thermally responsive element is subjected to no external force in a normal or closed circuit condition, the operating temperatures set in the state of a single unit of the thermally responsive element can be maintained.

In another preferred form, said one end of the movable plate is welded to the movable plate support. The movable plate has a through hole formed in said other end side thereof. The through hole has a smaller diameter than the through hole of the thermally responsive element. The movable contact has one end serving as a larger diameter portion and the other end serving as a smaller diameter portion. A thermally responsive element loosely fitting section is provided between the larger and smaller diameter portions. The loosely fitting section has such a diameter as to be allowed to be inserted through the hole of the thermally responsive element and disallowed to be inserted through the hole of the movable plate. The smaller diameter portion of the movable contact is inserted through the holes of the thermally responsive element and the movable plate and a distal end of the smaller diameter portion of the movable contact having passed through the movable plate is deformed so that the movable plate is held by an end face of the loosely fitting section to thereby be fixed in position and so that the thermally responsive element is loosely fitted with the loosely fitting section of the movable contact to be thereby held in position.

In further another preferred form, said one end of the movable plate is welded to the movable plate support. The movable plate has a through hole formed in said other end side thereof and having a smaller diameter than the through hole of the thermally responsive element. The movable contact includes a contact member and a thermally responsive element loosely fitting member having a loosely fitting section. The contact member has one end serving as a contact portion. The loosely fitting section of the thermally responsive element loosely fitting member is inserted through the hole of the thermally responsive element and thereafter, the contact member having passed through the hole of the movable plate and the thermally responsive element loosely fitting member are welded together so that the movable contact is held around a welded portion thereof by the movable plate to be thereby fixed in position and so that the thermally responsive element is loosely fitted with the loosely fitting section of the movable contact to be thereby held in position.

In further another preferred form, the thermally responsive switch further comprises a thermally responsive element loosely fitting member discrete from the movable contact. In this construction, the thermally responsive element loosely fitting member has one end serving as a larger diameter portion and the other end serving as a thermally responsive element loosely fitting section inserted through the hole of the thermally responsive element. The movable contact is directly welded to the movable plate. The thermally responsive element loosely fitting section is inserted through the hole of the thermally responsive element. A distal end of the thermally responsive element loosely fitting section is welded to a backside of the movable plate, so that the thermally responsive element is connected to and loosely fitted with the movable plate to thereby be held in position.

In further another preferred form, the movable plate has a through hole formed in said other end side thereof and having a smaller diameter than the through hole of the thermally responsive element. The movable contact has one end serving as a larger diameter portion and the other end serving as a smaller diameter portion. A thermally responsive element loosely fitting section is provided between the larger and smaller diameter portions. The loosely fitting section has such a diameter as to be allowed to be inserted through the hole of the thermally responsive element and disallowed to be inserted through the hole of the movable plate. The movable contact is inserted through the holes of the thermally responsive element and the movable plate. The movable plate is welded to an end face of the thermally responsive element loosely fitting section to thereby be fixed in position. The thermally responsive element is loosely fitted with the thermally responsive element loosely fitting section to thereby be held in position.

In further another preferred form, the thermally responsive switch further comprises a reinforcing plate having a through hole. In this construction, the smaller diameter portion of the movable contact is inserted through the through hole of the reinforcing plate when being inserted through the holes of the thermally responsive element and the movable plate. The movable contact having passed through the hole of the movable plate is further inserted through the hole of the reinforcing member and fixed to an end face of the thermally responsive element loosely fitting section by crimping or the like. Furthermore, the movable plate preferably includes a wear plate welded to a portion thereof fixed to the movable plate support for preventing deformation of a portion thereof around the fixed portion. The wear plate is welded to the fixed portion so as to hold the movable plate between itself and the movable plate support. Additionally, the thermally responsive switch preferably further comprises a positioning member interposed between the movable plate support to which the movable plate is secured and the fixed contact section. The positioning member determines a positional relation between the movable contact and the fixed contact section.

BRIEF DESCRIPTION OF THE DRAWINGS

Other objects, features and advantages of the present invention will become clear upon reviewing the description of the preferred embodiments, made with reference to the accompanying drawings, in which.

DETAILED DESCRIPTION OF THE PREFERRED EMBODIMENTS

Figure 1:
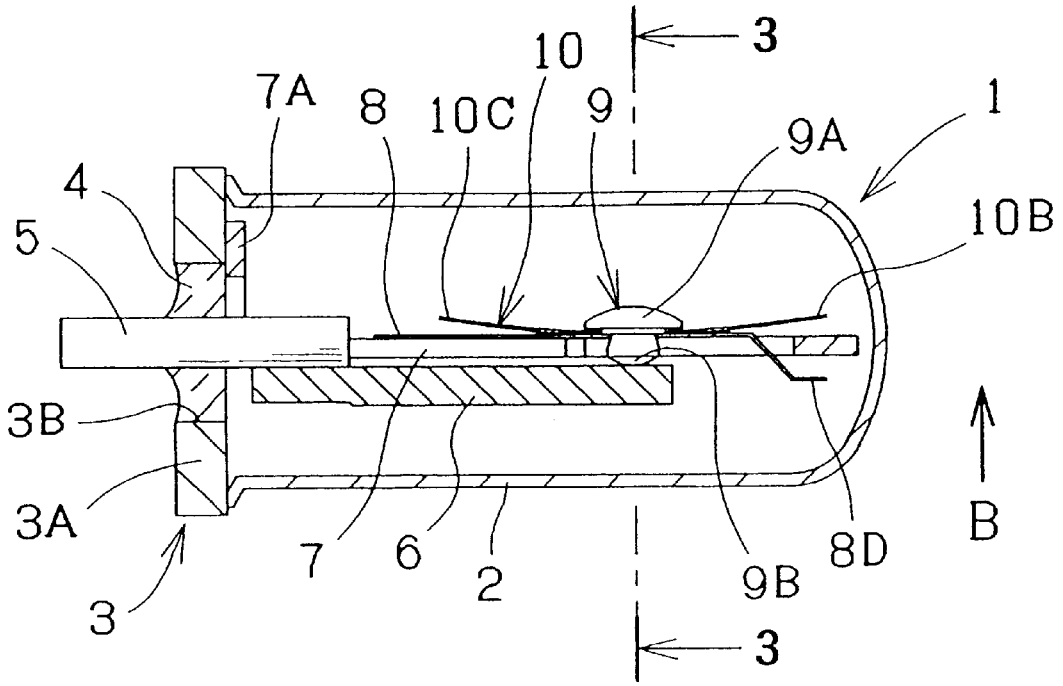
FIG. 1 is a longitudinal section of the thermally responsive switch of a first embodiment in accordance with the present invention in a normal state.

A first embodiment of the present invention will be described with reference to FIGS. 1 to 6. Referring to FIG. 1, the thermally responsive switch 1 of the first embodiment is shown. The thermally responsive switch 1 comprises a metal housing 2 having an open end and a closed end and formed into the shape of a bottomed cylinder and a header plate 3 comprising a metal disc. The header plate 3 includes a metal circular plate 3A having a central through hole 3B and an electrically conductive lead terminal pin 5 inserted through the hole 3B to be fixed in position. The terminal pin 5 is hermetically secured in the hole 3B by an insulating material such as glass 4 so as to extend therethrough in an insulated relation with the metal plate 3A. The plate 3A of the header plate 3 is secured to the open end of the housing 2 by welding or the like airtightly over the entire circumference of the plate 3A, so that the housing 2 and the header plate 3 constitute an airtight housing. A gas of a composition selected in view of heat conductivity etc. fills an interior of the airtight housing. The above-described airtight structure can maintain the composition of the gas with no change for a long period.

A generally prismatic fixed contact section 6 is electrically conductively secured to an end of the terminal pin 5 located in the airtight housing. Although the fixed contact section 6 is thus discrete from the terminal pin 5, the terminal pin may be extended and cranked so as to assume a position where it is engaged with and disengaged from a movable contact as will be described later or may be secured so as to be off-centered relative to the circular plate 3A, so that a distal end thereof or a portion near the distal end serves as the fixed contact section.

A movable plate support 7 serving as a stationary member with a high rigidity has one end 7A secured to the plate 3A of the header plate 3. The movable plate support 7 comprises a metal plate having a central space 7B provided for maintaining a necessary clearance for insulation between itself and each of the terminal pin 5 and the fixed contact section 6. The movable plate support 7 is bent at the end 7A side so as to formed into an L-shape. The movable plate support 7 is disposed generally in parallel with the fixed contact section 6. An elastic movable plate 8 has an end including a mounting portion 8A secured to the movable plate support 7 by welding or the like. The movable plate 8 comprises a leaf spring-like electrically conductive metal plate so as to have a biasing force pressing an opposite distal end 8B against the support 7 side.

The movable plate 8 has a through hole 8C formed in the vicinity of the distal end 8B. A movable contact 9 is fixed in the hole 8C by crimping etc. A damping section 8D is provided at the distal end of the movable plate 8. When a force due to impact acceleration is applied to the thermally responsive switch 1 in the direction of arrow B in FIG. 1, the damping section 8D receives the impact acceleration. Consequently,the mounting portion 8A and the portion of the movable plate 8 near the mounting portion 8A can be prevented from being excessively bent to be unable to recover respective former states or from plastic deformation.

The movable contact 9 includes at one end thereof a head 9A with a relatively large diameter and at the other end thereof a contact portion 9B engaging and disengaging from the fixed contact section 6. The contact portion 9B is made of a material such as silver or silver alloy with suitability for contact with the fixed contact section 6. The head 9A is preferably made of a material harder than the above-mentioned material for the contact portion 9B, so that the securing work can readily be performed when the movable contact 9 is fixed in the hole 8C of the movable plate 8 by crimping etc.

Figure 2:
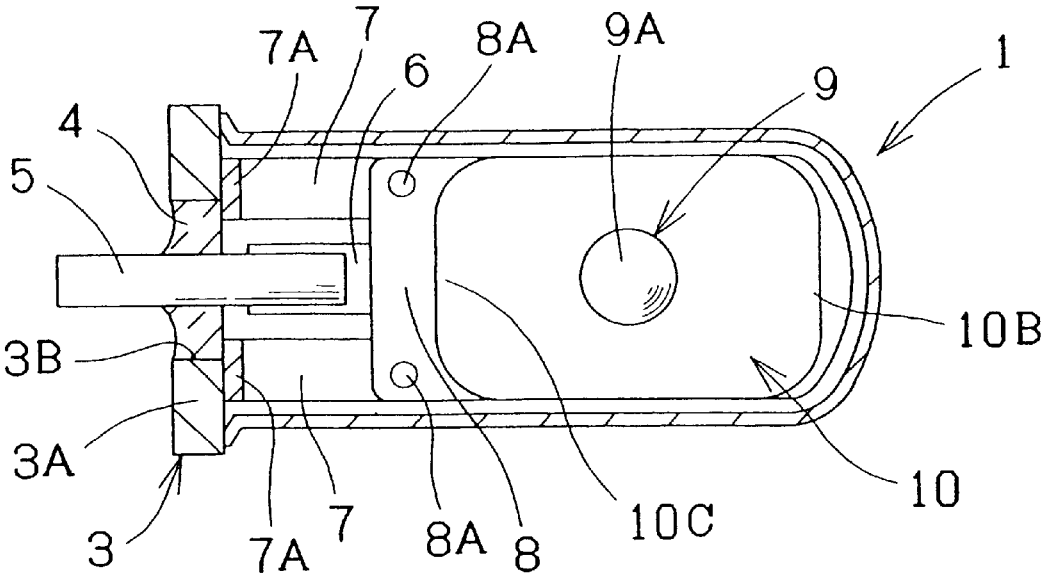
FIG. 2 is a transverse section of the thermally responsive switch.
Figure 3:
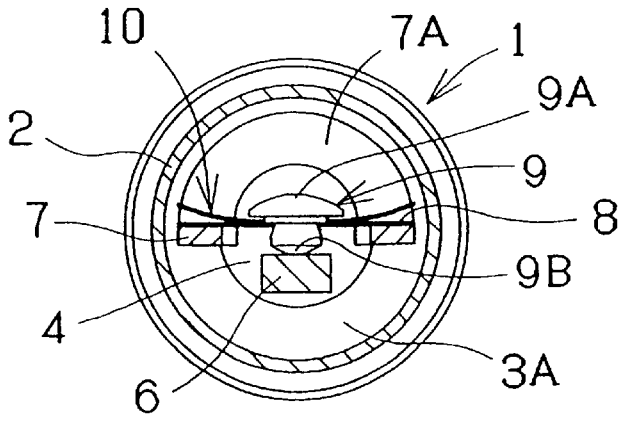
FIG. 3 is a sectional view taken along line 3—3 in FIG. 1.
Figure 4:
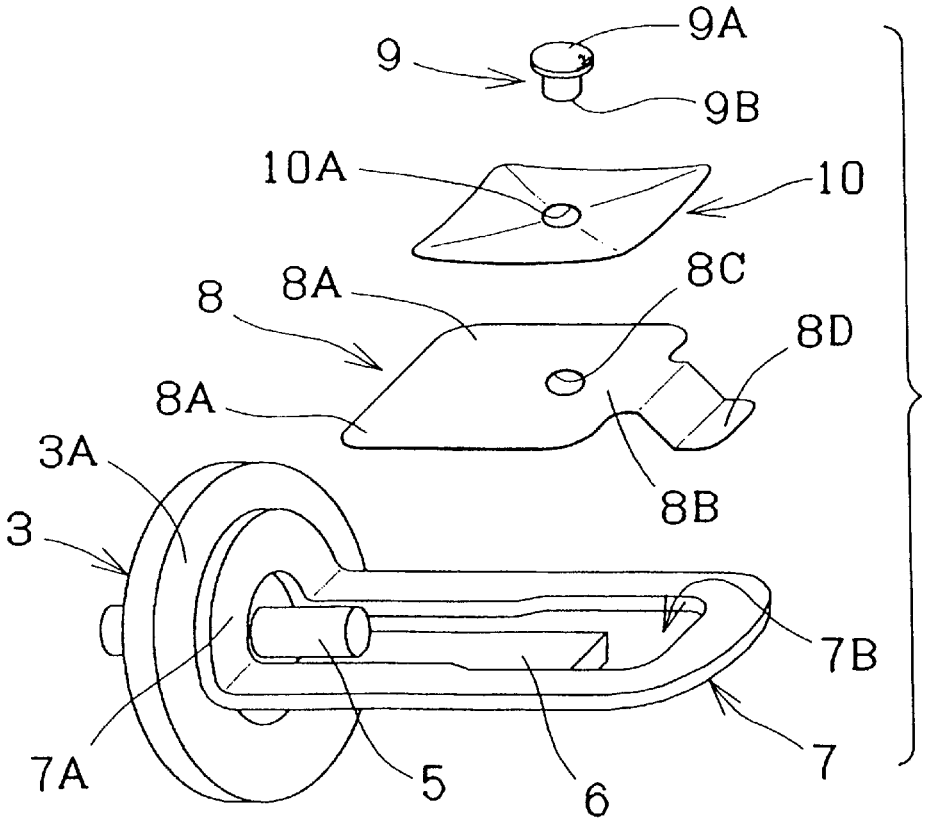
FIG. 4 is an exploded perspective view of the thermally responsive switch with the housing being eliminated.

The movable contact 9 further includes a shaft portion having a smaller diameter. The distal end of the shaft portion is deformed to serve as the contact portion 9B. A thermally responsive element 10 is disposed between the movable plate 8 and the head 9A. The thermally responsive element 10 comprises a thermally deformable metal plate, for example, a bimetal, formed into the shape of a shallow dish. The thermally responsive element 10 reverses its curvature with a snap action in response to a first predetermined temperature and re-reverses its curvature with a snap action in response to a second predetermined temperature. The thermally responsive element 10 has a through hole 10A formed in the vicinity of the center of the dish-shaped portion. The shaft portion of the movable contact 9 is inserted through the hole 10A. After having been inserted through the hole 10A, the shaft portion of the movable contact 9 is further inserted through the hole 8B of the movable plate 8. Thereafter, the shaft portion of the movable contact 9 is deformed by pressing into a shape as shown in FIGS. 1 to 3 so that the contact portion 9B is formed. The movable contact 9 is thus secured to the movable plate 8 by crimping etc. Consequently, the thermally responsive element 10 is disposed between the movable plate 8 and the head 9A of the movable contact 9. The material for the movable contact 9 is selected and the dimensions of the movable contact 9 are set so that the diameter of the shaft portion inserted through the hole 10A of the thermally responsive element 10 can be prevented from being increased in the hole 10A during the crimping of the movable contact 9.

The head 9A of the movable contact 9 has a stepped portion formed on the underside thereof. The stepped portion has a larger diameter than the shaft portion and a larger thickness than the thermally responsive element 10. A circumferential edge of the hole 10A of the thermally responsive element 10 is adapted to be fitted with the stepped portion with a clearance. The hole 8B of the movable plate 8 has a smaller diameter than the hole 10A of the thermally responsive element 10. Consequently, the thermally responsive element 10 is held to be loosely fitted at the location of the hole 10A with the shaft portion at the end 8B side of the movable plate 8. As the result of this loose fit, the operating temperature or the first predetermined temperature of the thermally responsive element 10 can be prevented from varying. In other words, the operating temperature of the thermally responsive element 10 set in the state of a single unit is maintained or agrees with the operating temperature after the assembly of the thermally responsive element 10 into the switch. On the other hand, some force is applied to the thermally responsive element in the conventional thermally responsive switches of the above-described type. Accordingly, the operating temperature set in the state of a single unit of the thermally responsive element varies after the thermally responsive element has been assembled into the switch in the prior art. This requires confirmation or calibration of the operating temperature of the thermally responsive element after the assembly of the element into the switch. In the embodiment, however, such confirmation or calibration of the operating temperature can be eliminated.

Although the shaft portion of the movable contact 9 has the stepped portion in the embodiment, the stepped portion may or may not be provided. The inventors made an experiment to carry out the crimping for the movable contact 9 without the stepped portion in the same manner as described above. Consequently, the inventors confirmed that the shaft of the movable contact 9 inserted through the hole 10A of the element 10 could be prevented from thickening or that the thermally responsive element 10 was held to be loosely fitted.

The operation of the thermally responsive switch will now be described with reference to FIGS. 1 and 5. The thermally responsive element 10 is normally convex to the side of the movable plate 8 as shown in FIG. 1. In this condition, the biasing force of the movable plate 8 causes the movable contact 9 to abut against the fixed contact section 6 with a predetermined contact pressure. An electric circuit made by the terminal pin 5, the fixed contact section 6, the movable contact 9, the movable plate 8, the movable plate support 7, and the header plate 3 is closed. When current flows through the electric circuit, no current flows into the thermally responsive element 10. Consequently, an adverse effect of the self-heating of the element 10 upon the operating temperature thereof can be ignored.

Figure 5:
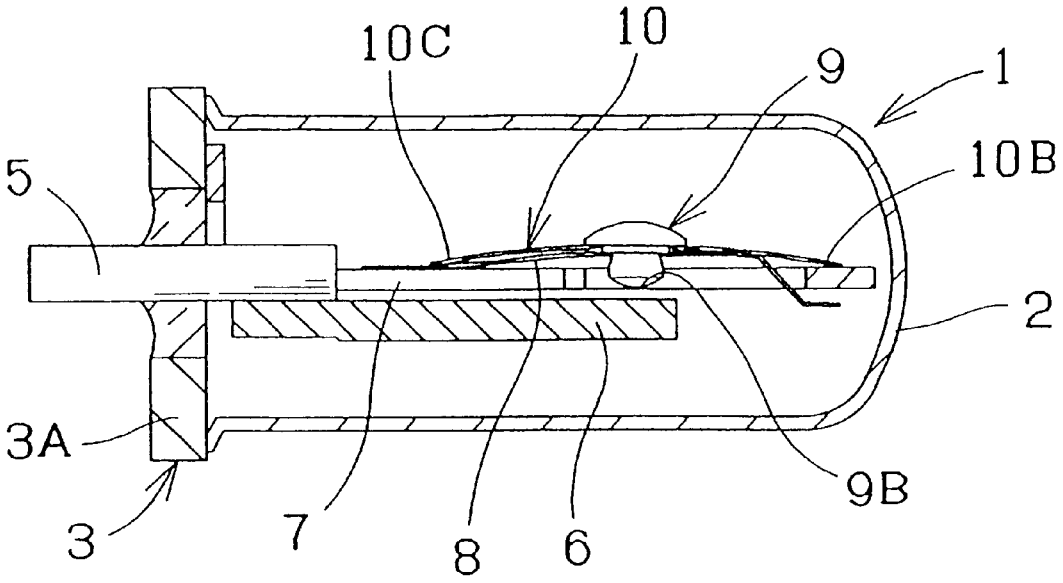
FIG. 5 is a longitudinal section of the thermally responsive switch in a reversed state.

The thermally responsive element 10 reverses its curvature with a snap action as shown in FIG. 5 when an ambient temperature around the thermally responsive switch increases to the first predetermined temperature. The opposite ends 10B and 10C of the thermally responsive element 10 abut the movable plate support directly or indirectly via the movable plate 8. The centrally positioned movable contact 9 is then disengaged from the fixed contact section 6 against the biasing force of the movable plate 8, so that the electric circuit is opened or cut off.

The movable plate 8, linked to the thermally responsive element 10 by the movable contact 9, raised at its portion near the hole 8B during the reverse of the element 10. Thus, the movable plate 8 is forced into three-dimensional deformation according to the curvature of the thermally responsive element 10. In this case, if the movable plate 8 has the same width as the thermally responsive element 10, there is a possibility that a restricting force may act to hold the movable plate 8 along the peripheral edge of the element 10 during the reverse of the latter. This restricting force would adversely affect the returning temperature of the thermally responsive element 10 or result in permanent deformation or breakage of the movable plate 8 when the thermally responsive switch operates repeatedly. In the embodiment, however, the rightwardly protruding portion of the movable plate 8 is shorter than that of the element 10 as viewed in FIG. 1 although the width of the movable plate 8 is approximately equal to that of the element 10. Consequently, the restricting force as described above does not act. Furthermore, occurrence of the restricting force can be prevented when the width of the movable plate 8 is rendered smaller in the midst thereof than that of the element 10 or when the movable plate is provided with a slit preventing the three-dimensional deformation. Consequently, the above-described disadvantage can be reduced.

Figure 6:
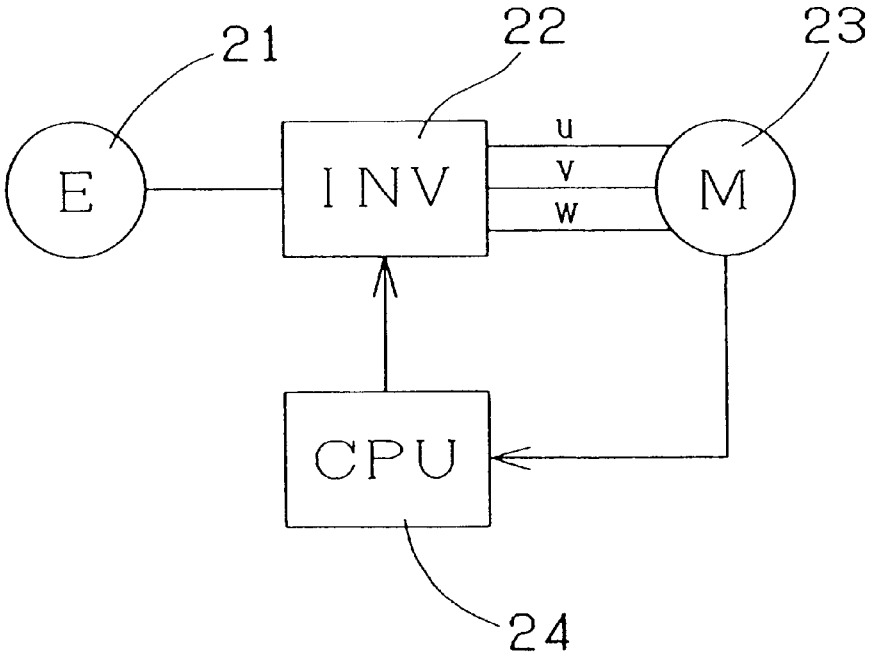
FIG. 6 is a schematic block diagram of a three-phase inverter controlled motor-driven compressor to which the thermally responsive switch of the first embodiment is mounted.

An example of protection of a motor by the thermally responsive switch 1 will now be described with reference to FIG. 6. Referring to FIG. 6, a three-phase inverter controlled motor-driven compressor to which the thermally responsive switch of the first embodiment is mounted is schematically shown. The compressor includes a power supply 21 obtained by converting alternating current to direct current by a converter (not shown) and an inverter circuit 22 for converting the direct current from the power supply 21 to desired alternating current. The inverter circuit 22 comprises semiconductor switching elements for controlling the direct current. When the inverter circuit 22 supplies the current to an electric motor 23, it produces an approximate three-phase rotating magnetic field, which field drives a rotor of the motor. A control circuit 24 is provided for controlling the inverter circuit 22. Various signals indicative of parameters such as a load, ambient temperature, etc. are supplied into the control circuit 24. The control circuit 24 varies an output frequency and current of the inverter circuit 22 to control a rotational speed of the motor 23 so that the compressor is operated under an optimum condition based on the parameters. Thus, the compressor can perform sufficiently and operate efficiently.

The motor 23 is provided with a rotation detecting device monitoring the rotational speed and a rotation direction thereof. The rotation detecting device delivers to the control circuit 24 signals of phase sequence according to the rotating magnetic field of the motor. For example, these signals deviate from their normal states when the motor 23 has run into a locked condition or a phase interruption. Detecting the deviation of the signals, the control circuit 24 determines that the motor 23 is in an abnormal condition, thereby stopping power supply from the inverter circuit 22 to the motor 23.

The thermally responsive switch 1 is connected so as to open and close any one of power supply lines u, v and w to the motor 23. The switch 1 is mounted in the hermetic housing of the enclosed motor-driven compressor to assume such a position that changes in the temperatures of the motor and a refrigerant can be quickly sensed. Accordingly, the thermally responsive switch 1 operates in response to an overheat due to the abnormal condition of the motor or loss of charge of the refrigerant to cut off one of the power supply lines to the motor 23 so that the corresponding phase of the motor is interrupted. The control circuit 24 stops power supply to the motor 23 when the signals supplied thereto from the motor 23 is deviated from the normal states. The thermally responsive switch 1 has a simple construction and can yet stop the inverter-controlled motor 23 for the compressor in response to an abnormally increased temperature, thereby evading a danger.

The thermally responsive switch 1 is used to protect the enclosed motor-driven compressor comprising the inverter-controlled motor in the foregoing embodiment. However, the switch 1 may be used for various purposes other than the protection of the inverter-controlled motor.

In order that the thermally responsive switch 1 may be rendered small in size, the movable plate 8 on which the movable contact 9 is mounted is made of a sufficiently thin metal plate so as to be able to operate according to the movement of the thermally responsive element 10. In the case where the movable plate 8 is thin, there is a possibility of occurrence of strain or distortion due to plastic deformation when the movable contact 9 is fixed to the movable plate 8, when the movable plate 8 is welded to the conductive base or when a bending stress is applied to the movable plate 8 in the actual use. Upon occurrence of the strain, the contact pressure between the movable contact 9 and the fixed contact section 6 and an inter-contact distance at the time of disengagement are sometimes outside respective predetermined ranges thereof. The inventors provide the construction of the following second embodiment to prevent occurrence of the above-described strain.

The second embodiment of the invention will be described with reference to FIGS. 7 to 12. The thermally responsive switch 101 of the second embodiment comprises a metal housing 102 having an open end and a closed end and formed into the shape of a bottomed cylinder and a header plate 103 closing the open end of housing 102. The header plate 103 includes a metal circular plate 103A having a central through hole 103B and an electrically conductive lead terminal pin 105 inserted through the hole 103B and secured in the hole by an insulating filler 104 such as glass. The plate 103A of the header plate 103 is secured to the open end of the housing 102 by welding or the like airtightly over the entire circumference of the plate 103A, so that the housing 102 and the header plate 103 constitute an airtight housing. A gas of a composition selected in view of heat conductivity etc. fills an interior of the airtight housing. The above-described airtight structure can maintain the composition of the gas with no change for a long period. In the second embodiment, the filling gas contains 75% of helium gas with fine thermal conductivity by volume and 25% of nitrogen by volume. A percentage content of helium is preferably set at or above 10% form the standpoint of heat conductivity. Furthermore, an inter-contact withstand voltage is lowered in the contact-breaking state when the concentration of helium is too high. Accordingly, the concentration of helium is preferably at or below 90%.

A generally prismatic fixed contact section 106 is electrically conductively secured to an end of the terminal pin 5 located in the airtight housing. Although the fixed contact section 106 is thus discrete from the terminal pin 105, the terminal pin may be extended and cranked so as to assume a position where it is engaged with and disengaged from a movable contact as will be described later or may be secured so as to be off-centered relative to the circular plate 103A, so that a distal end thereof or a portion near the distal end serves as the fixed contact section.

A movable plate support 107 serving as a member with a high rigidity has one end 107A secured to the plate 103A of the header plate 103. The movable plate support 107 comprises a metal plate having a central space 107B provided for maintaining a necessary clearance for insulation between itself and each of the terminal pin 105 and the fixed contact section 106. The movable plate support 107 includes a fixed end 107A bent so that the support is formed into an L-shape. The movable plate support 107 is disposed generally in parallel with the fixed contact section 106. An elastic movable plate 108 has an end including two mounting portions 108A secured to the movable plate support 107 by welding or the like. The movable plate 108 comprises a leaf spring-like electrically conductive metal plate so as to have a biasing force pressing an opposite distal end 108B side against the support 107 side.

The movable plate 108 comprises a thin metal plate so that it is elastically moved with the reversing operation of a thermally responsive element 110 as will be described later and so that the thermally responsive switch 101 is rendered small in size. Accordingly, when the movable plate 108 is welded only at the mounting portions 108A, there is a possibility that plastic deformation of the movable plate 108 may result from concentration of bending stress on the mounting portions 108A or portions thereof near the mounting portions during the operation of the thermally responsive element 110. Upon occurrence of the plastic deformation of the movable plate 108, the biasing force thereof may be decreased from its initial value. To prevent the decrease in the biasing force, a wear plate 111 is also welded to fixed portions of the movable plate 108, namely, the mounting portions 108A when the movable plate is welded to the movable plate support 107. Consequently, even when the bending stress is concentrated on the mounting portions 108A, the wear plate 111 prevents the deformation of the movable plate 108, thereby restraining a decrease in the biasing force of the movable plate.

Figure 7:
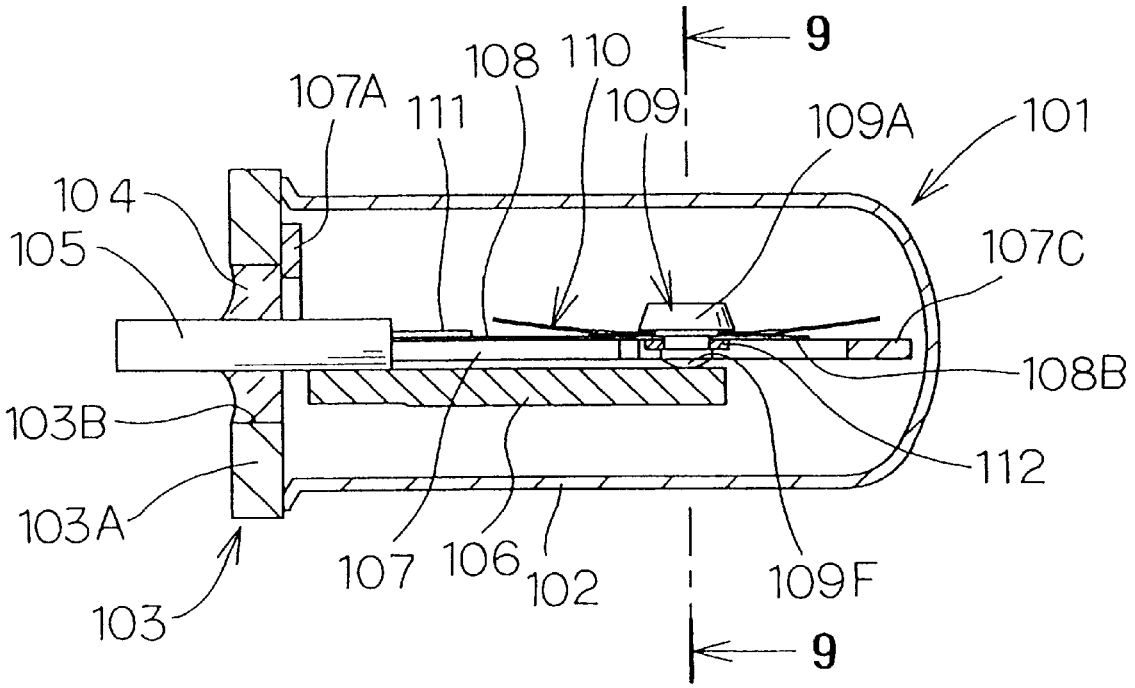
FIG. 7 is a longitudinal section of the thermally responsive switch of a second embodiment in accordance with the present invention in the normal state.
Figure 9:
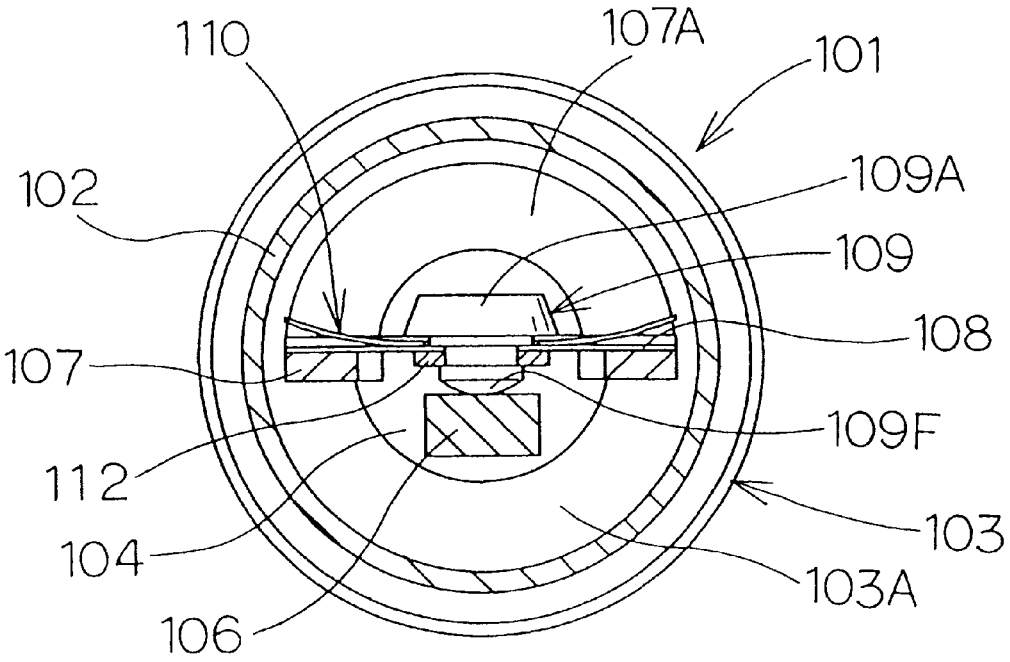
FIG. 9 is a sectional view taken along line 9—9 in FIG. 7.
Figure 10A:
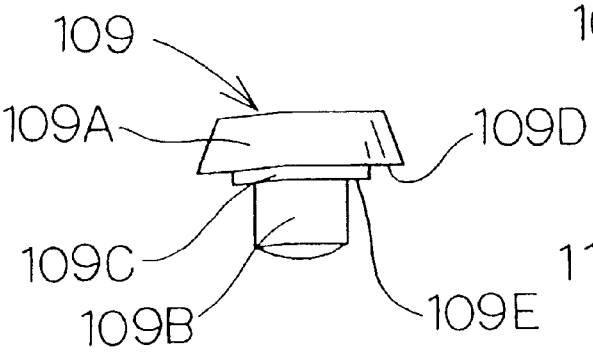
FIGS. 10A and 10B show a movable contact used in the thermally responsive switch.
Figure 10B:
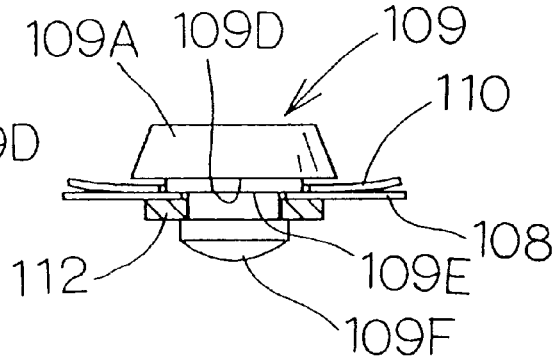

The movable plate 108 has a through hole 108C formed in the vicinity of the distal end 108B. A movable contact 109 is fixed in the hole 108C by crimping etc. The movable contact 109 includes at one end thereof a head 109A with a relatively large diameter and at the other end thereof a columnar small diameter portion 109B before the crimping as shown in FIG. 10A. The movable contact 109 further includes a thermally responsive element loosely fitting section 109C between the head 109A and the small diameter portion 109B. The loosely fitting section 109C has a diameter smaller than the head 109A but larger than the small diameter portion 109B. The loosely fitting section 109C has a thickness, namely, a dimension between an end face 109D of the head 109A and an end face 109E thereof, larger than the thermally responsive element 110 which will be described later. The movable contact 109 is fixed to the movable plate 108 by crimping by means of pressing as best shown in FIGS. 7, 9 and 10B. At this time, the distal end of the small diameter portion 109B is formed into a contact portion 109F engaging and disengaging from the fixed contact section 106 as shown in FIG. 7, 9 and 10B. The movable contact 109 is made of a material such as silver or silver alloy with suitability for contact with the fixed contact section 106. The head 109A and the loosely fitting section 109C are preferably made of a material harder than the material for the contact portion 109B, so that the securing work can readily be performed when the movable contact 109 is crimped as described above.

The thermally responsive element 110 comprises a thermally deformable metal plate, for example, a bimetal or trimetal, formed into the shape of a shallow dish. The thermally responsive element 110 reverses its curvature with a snap action at a first predetermined temperature and returns to its former curvature with a snap action at a second predetermined temperature. The thermally responsive element 110 has a through hole 110A formed in the vicinity of the center of the dish-shaped portion. The movable contact 109 is inserted through the hole 110A as will be described later. The thermally responsive element 110 further has, for example, four slits 110B extending radially from the hole 11A. The hole 11A has a larger diameter than the hole 108C of the movable plate 108. Portions between the slits 10B serve as arms 10C each of which increases an amount of displacement of the peripheral portion of the element 110. The arms 110C can increase an amount of movement of the movable contact 109 as compared with the case where the thermally responsive element has no such slits, so that the distance between the contacts can be increased when the contacts are disengaged from each other. Furthermore, if an apparent distance between the contacts is the same, an amount of bias of the movable contact 108 to the fixed contact section 106 side is increased such that the contact pressure can be increased.

Assembly of the movable contact 109, the movable plate 108 and the thermally responsive element 110 will now be described. First, the small diameter portion 109B of the movable contact 109 is inserted through the hole 10A of the thermally responsive element 110. The hole 110 has an inner diameter slightly larger than an outer diameter of the loosely fitting section 109C of the movable contact 109. Accordingly, the thermally responsive element 110 abuts the head end face 109D of the movable contact 109. The small diameter portion 109B is further inserted through the hole 108C of the movable plate 108. The hole 108C has a diameter smaller than the hole 110A of the thermally responsive element 110 and the outer diameter of the loosely fitting section 109C of the movable contact 109. Accordingly, the movable plate 108 abuts the end face 109E of the loosely fitting section 109.

A reinforcing plate, for example, a washer 112 is attached to the movable contact 109 after it has been inserted through the movable plate 108. The washer 112 is made of a metal plate having such a thickness and strength that it is not deformed during the crimping of the movable contact 109. The washer 112 abuts the circumference of the hole 108C of the movable plate 108 to thereby reinforce the plate 108 so that it is prevented from strain due to deviation of force applied during the crimping. The washer 112 may be eliminated when the strain of the movable plate 108 due to its deformation is not serious. For example, the washer 112 can be eliminated when slits are formed around the crimped portion of the movable plate 108 to let the strain due to deformation escape or when the length of the movable plate 108 is increased or its thickness is increased with the elasticity being maintained.

The distal end of the small diameter portion 109B of the movable contact 109 is deformed by pressing etc. into a contact portion 109F after the contact 109 has been inserted through the thermally responsive element 110, the movable plate 108 and the washer 112 sequentially, as shown in FIG. 10B. The contact portion 109F has a larger diameter after the pressing than before the pressing, thereby holding the washer 112 in position. The peripheral edge of the hole 108C of the movable plate 108 is held between the end face 109E of the loosely fitting section of the movable contact 109 and the washer 112, whereby the movable plate 108 is fixed. The thermally responsive element 110 is located at the loosely fitting section 109C of the movable contact 109. The thickness of the loosely fitting section 109C is larger than that of the thermally responsive element 110 as described above. The loosely fitting section 109C is further made so as not to be substantially deformed during the crimping. As a result, the thermally responsive element 110 is loosely held at its hole 110A portion by the loosely fitting section 109C so that movement thereof is not restricted. Accordingly, the operating temperature or the first predetermined temperature of the thermally responsive element 110 can be prevented from being varied by the above-described assembly. In other words, the operating temperature of the thermally responsive element 110 set in the state of a single unit is maintained or agrees with the operating temperature after the assembly of the thermally responsive element 110 into the switch 101. Consequently, the confirmation or calibration of the operating temperature of the element 110 can be eliminated in the embodiment. On the other hand, some force is applied to the thermally responsive element in the conventional thermally responsive switches of the above-described type. Accordingly, the operating temperature set in the state of a single unit of the thermally responsive element varies after the thermally responsive element has been assembled into the switch in the prior art. This requires confirmation or calibration of the operating temperature of the thermally responsive element after the assembly of the element into the switch.

Figure 8:
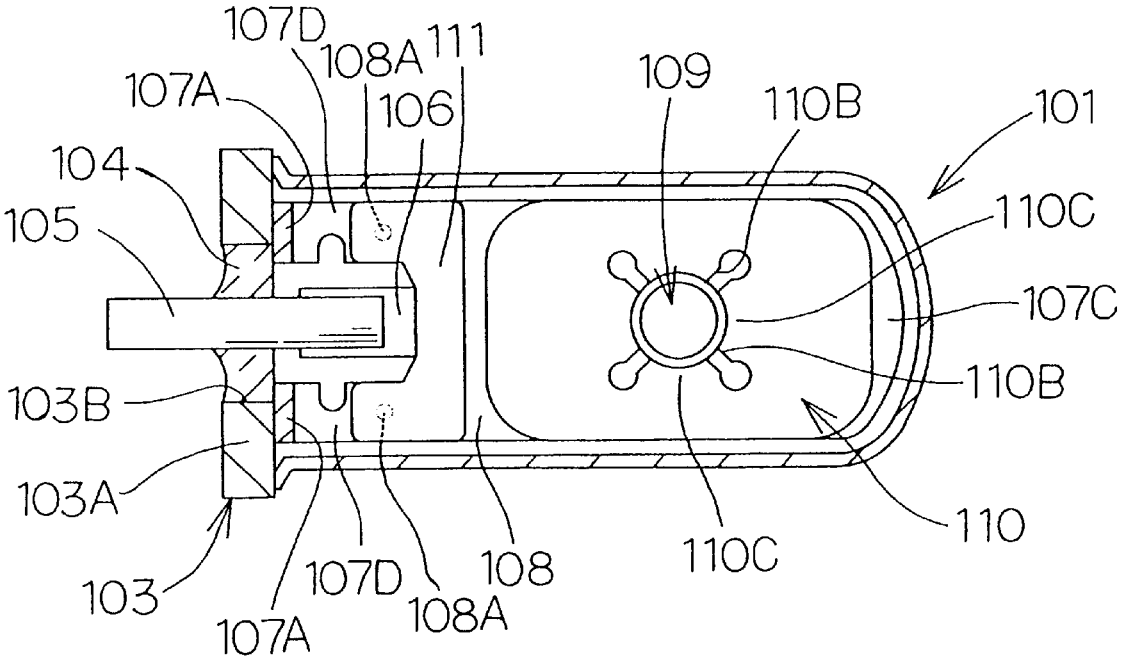
FIG. 8 is a transverse section of the thermally responsive switch of the second embodiment.
Figure 11:
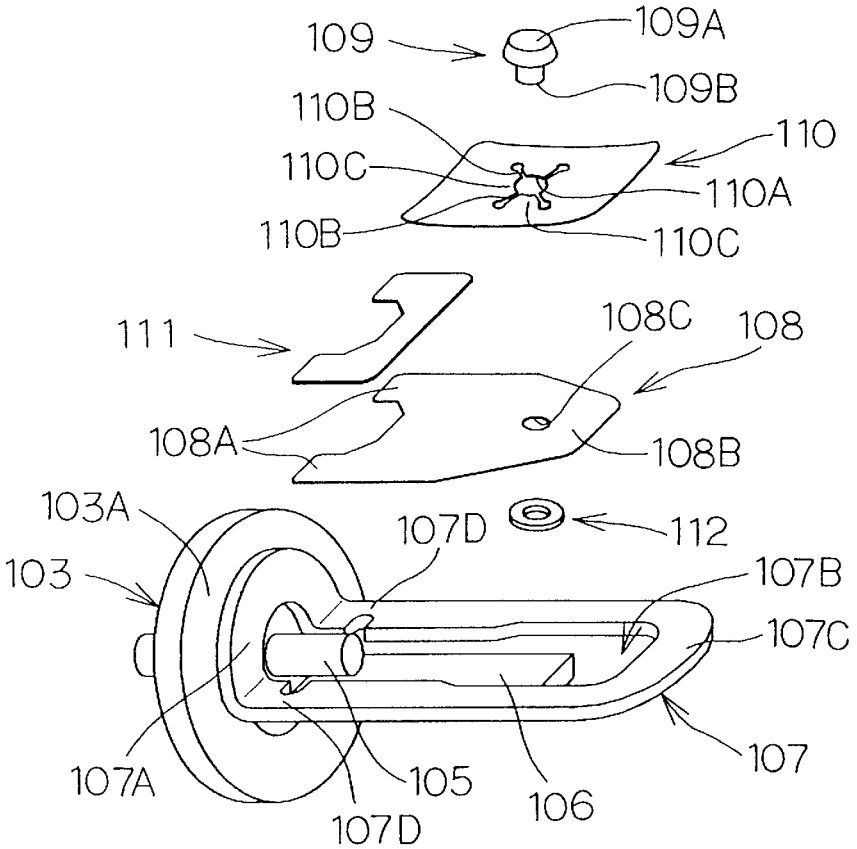
FIG. 11 is an exploded perspective view of the thermally responsive switch of the second embodiment with the housing being eliminated.

Furthermore, all the parts composing a circuit of the thermally responsive switch 101 or a switch mechanism are assembled to the header plate 103. Positional relations between the parts and the operation of the switch mechanism can directly be confirmed before the header plate 103 is secured to the housing 102. When the contact pressure and the distance between the movable contact 109 and the fixed contact section 106 in the disengaged state need to be adjusted, the movable plate support 107 or the fixed contact section 106 is suitably bent, so that the positional relation can be adjusted between the face the head end face 109D of the movable contact 109 abuts at the movable plate support 107 side and the contact face of the fixed contact section 106. In execution of the adjusting work, the distal end 107C of the movable plate support 107 is displaced vertically as viewed in FIG. 7, whereby the positional relation can be adjusted. A smaller width portion 107D is provided near the end 107A of the support 107 where it is fixed to the header plate 103, as shown in FIGS. 8 and 11. The smaller width portion 107D renders deformation of the support 107 easy in the above-described adjustment. In this construction, the adjustment can be carried out without deformation of the distal end side from the mounting portions 108A of the movable plate 108. Consequently, the adjusting work can reliably executed with no change in the biasing force previously set in the movable plate 108.

Figure 12:
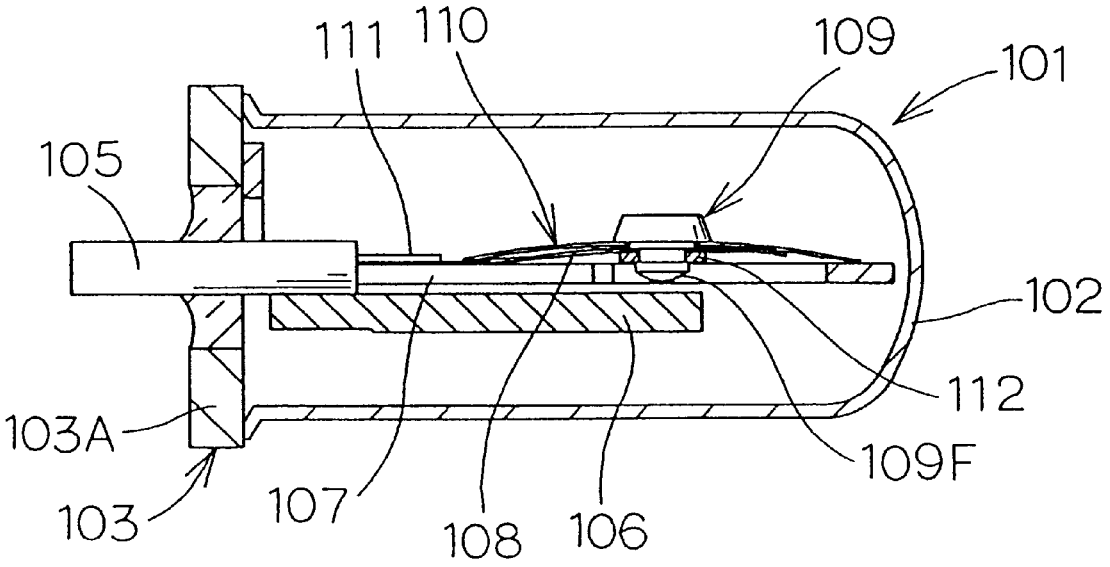
FIG. 12 is a longitudinal section of the thermally responsive switch of the second embodiment in the reversed state.

The operation of the thermally responsive switch 101 will now be described with reference to FIGS. 7 and 12. The thermally responsive element 110 is normally convex or curved to the side of the movable plate 108 as shown in FIG. 7. In this condition, the biasing force of the movable plate 108 causes the movable contact 109 to abut against the fixed contact section 106 with a predetermined contact pressure. An electric circuit made by the terminal pin 105, the fixed contact section 106, the movable contact 109, the movable plate 108, movable plate support 107, and the header plate 103 is closed. Assume now that the thermally responsive switch 101 is mounted on an electric motor to protect it. When current flows through the electric circuit, an operating current of the motor does not substantially flow into the thermally responsive element 110. Consequently, an adverse effect of the operating current of the motor upon the operating temperature thereof can be ignored since the operating current does not cause the thermally responsive element 110 to self-heat. Furthermore, the hermetic housing of the switch 101 is filled with the heat-conductive mixed gas containing helium. Heat generated by the electric circuit is radiated through the mixed gas and the housing externally when the ambient temperature is low. Consequently, the thermally responsive element 110 can be prevented from reversing its curvature in response to the Joule heat due to resistance of the electric circuit.

The ambient temperature around the thermally responsive switch 101 increases when the motor has run into the overheated condition for some reason. Heat is transferred through the housing and the mixed gas to the interior of the housing. The thermally responsive element 110 reverses its curvature with a snap action as shown in FIG. 12 when the temperature thereof increases to the first predetermined temperature. The opposite ends of the thermally responsive element 110 abut the movable plate support 107 directly or indirectly via the movable plate 108. The movable contact 109 positioned in the center of the element 110 is then moved upward against the biasing force of movable plate 108 as viewed in FIG. 12. As a result, the contact portion 109F of the movable contact 109 is disengaged from the fixed contact section 106, so that the electric circuit is opened or cut off.

Figure 13:
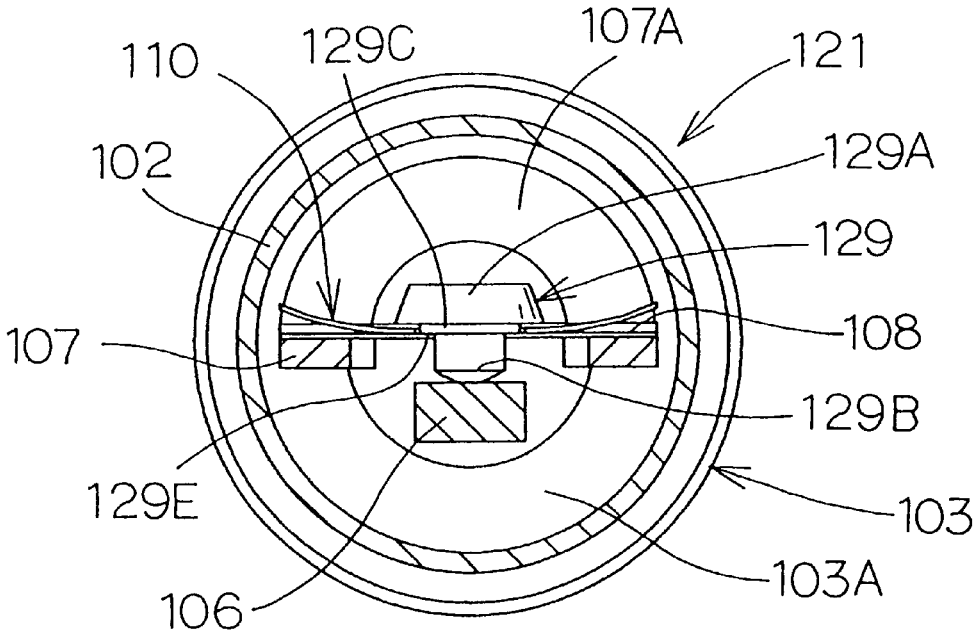
FIG. 13 is a view similar to FIG. 9, showing the thermally responsive switch of a third embodiment in accordance with the present invention.

FIG. 13 illustrates a third embodiment of the invention. The movable contact 109 is fixed to the elastic plate or the movable plate 108 by the crimping in the above-described embodiment. The movable contact may be fixed to the movable plate 108 by welding, instead. The third embodiment is directed to the welding of the movable contact 109. The identical or similar parts in the third embodiment are labeled by the same reference symbols as in the second embodiment and the description of these parts will be eliminated.

Referring to FIG. 13 showing the thermally responsive switch 121, the movable contact 129 is welded to the movable plate 108 after having been inserted through the thermally responsive element 110 and the movable plate 108 in turn. The movable contact 129 is formed into the same configuration as the above-described movable contact 109. The movable contact 129 includes at one end thereof a head 129A with a relatively large diameter and at the other end thereof a columnar small diameter portion 129B. The movable contact 129 further includes a thermally responsive element loosely fitting section 129C between the head 129A and the small diameter portion 129B. The distal end of the small diameter portion 129B is formed into the configuration of the contact portion before the assembly. Accordingly, the pressing carried out for the movable contact 109 in the foregoing embodiment is eliminated.

The thermally responsive element 110 has a larger through hole 110A than the movable plate 108. The shaft of the movable contact 129 is inserted through the hole 110A so that the thermally responsive element 110 is loosely fitted with the loosely fitting section 129C. In this case, the movable plate 108 is in abutment with the end face 129E of the loosely fitting section 129C. The end face 129E is then welded to the movable plate 108 so that the movable plate and the movable contact 129 are fixed together. Furthermore, since the loosely fitting section 129C is formed so as to have a larger thickness than the thermally responsive element 110, the latter is loosely held so that the movement thereof is not restricted. A reinforcing member such as a washer may be attached to the welded portion when strain due to deformation caused during the welding adversely affects the operation of the movable plate. Alternatively, slits may be formed around the welded portion to cause the strain to escape.

Figure 14A:
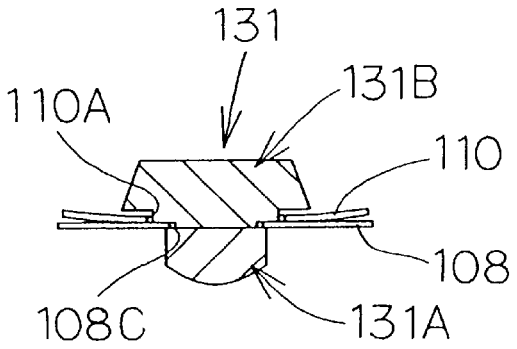
FIGS. 14A and 14B are views similar to FIG. 10B, showing the thermally responsive switches of fourth and fifth embodiments in accordance with the present invention respectively.

FIG. 14A illustrates a fourth embodiment of the invention. In the fourth embodiment, the movable contact 131 comprises two separate members, that is, a contact member 131A and a thermally responsive element loosely fitting member 131B. The shaft of the loosely fitting member 131B is first inserted through the holes 108C and 110A of the movable plate 108 and the thermally responsive element 110 respectively. Thereafter,the distal end of the shaft of the loosely fitting member 131B and the contact member 131A are welded together. The movable plate 108 and the thermally responsive element 110 are interposed between the two members 131A and 131B of the movable contact 131 by the above-described welding so that the movable plate is fixed in position and so that the thermally responsive element is loosely fitted at the hole 110A portion thereof with the loosely fitting member 131B.

Figure 14B:
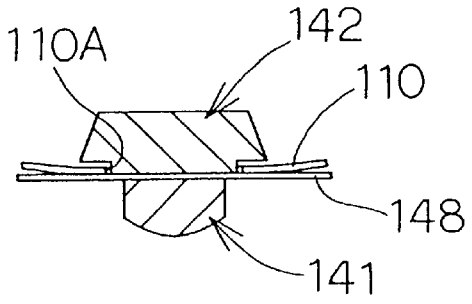

FIG. 14B illustrates a fifth embodiment of the invention. In the fifth embodiment, a movable plate 148 having no through hole is used, and a movable contact 141 is welded to the lower side of the movable plate as viewed in FIG. 14B. A thermally responsive element loosely fitting member 142 including a large diameter portion and a loosely fitting section is welded to the underside or the upper side of the movable plate 148 so as to correspond to the movable contact 141, as viewed in FIG. 14B. The positions of the loosely fitting member and the movable contact both welded to the movable plate 148 may be offset in the direction vertical to the drawing paper of FIG. 14B, for example, to the side of the header plate 103, so that an energizing path may be shortened. Consequently, an amount of heat generated on the energizing path can be reduced.

In each of the fourth and fifth embodiments, the thermally responsive element 110 is loosely fitted at the hole 110A thereof with the loosely fitting member 131B or 142 to thereby be held in position. The element 110 is further connected to the end 108B side of the movable plate 108. The construction for loosely fitting and holding the element 110 is the same as in each of the foregoing embodiments.

In the foregoing embodiments, the movable plate support is deformed for adjustment of the contact pressure between the movable and fixed contacts, namely, for adjustment of the positional relation between the movable plate support and the fixed contact. However, deformation of the movable plate results in springback. The above-described adjusting work needs to be carried out in consideration of the springback. This reduces the efficiency of the adjustment. Dimensional tolerances of the parts both in the manufacture and assembly need to be strictly controlled and have difficulty.

Figure 15:
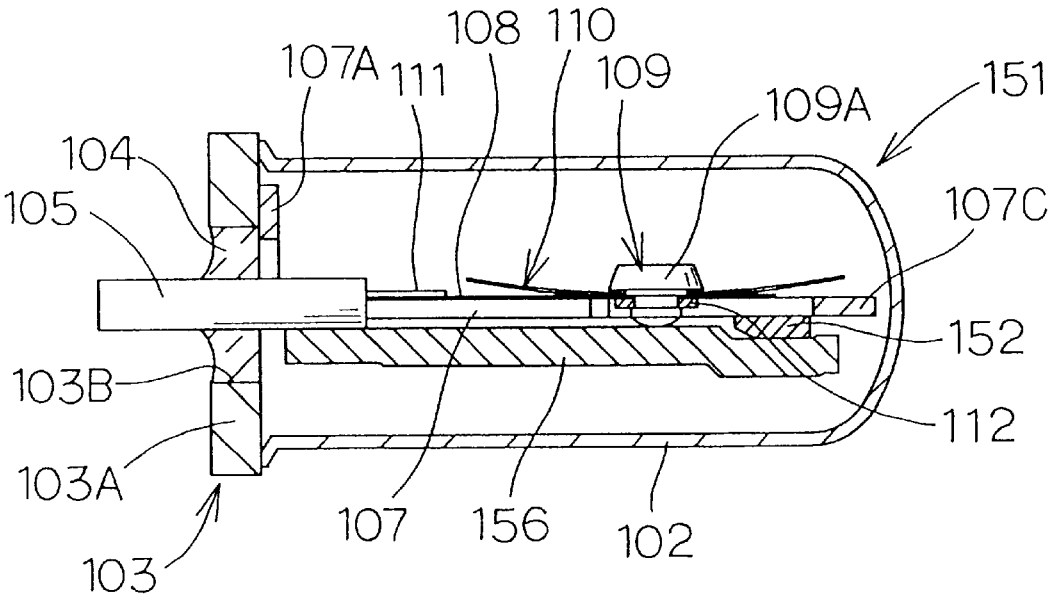
FIG. 15 is a view similar to FIG. 7, showing the thermally responsive switch of a sixth embodiment in accordance with the present invention.

FIG. 15 illustrates a sixth embodiment of the invention. The sixth embodiment is directed to an improvement in easy execution of the above-described adjusting work. The identical or similar parts in the sixth embodiment are labeled by the same reference symbols as in the foregoing embodiments and the description of these parts will be eliminated. In the thermally responsive switch 151 of the sixth embodiment, the fixed contact section 156 is extended along the movable plate support 107. A positioning member 152 made of an insulator is disposed in the vicinity of the distal end of the fixed contact section 156. The positioning member 152 determines a distance between the fixed contact section 156 and the movable plate support 107.

The adjusting work in the sixth embodiment will now be described. The fixed contact section 156 and the movable plate support 107 are previously assembled so that the distance between the distal ends of both of them becomes smaller than a proper value such that the contact pressure is increased. Instead of deforming either member, the positioning member 152 having a predetermined thickness is put between both members, whereby the distance between the fixed contact section 156 and the movable plate support 107 is determined.

The positioning member 152 is formed into the shape of a wedge in a direction of insertion as shown in FIG. 15. The positioning member 152 has opposite ends extending between the ends of the movable plate support 107 so as to bridge over the central space. When the positioning member 152 is thus inserted between the fixed contact section 156 and the movable plate support 107, the upper faces of the opposite ends thereof abut the portion of the support 107 near the distal end 107C, and the central lower face of the positioning member 152 abuts a portion of the fixed contact section 156 near the distal end thereof, as viewed in FIG. 15. The positioning member 152 is thus held between the fixed contact section 156 and the movable plate support 107. The positioning member 152 is held more reliably when either section 156 or support 107 is provided with a detent. The space between the section 156 and the support 107, which is previously smaller than the proper value, is increased by the use of the positioning member 152 to such a value that a predetermined positional relation is obtained between the section 156 and the support 107. In the above-described embodiment, the adjusting work requires only the positioning member 152 to be inserted between the section 156 and the support 107. Consequently, the adjusting work can be simplified to a large extent.

Figure 16:
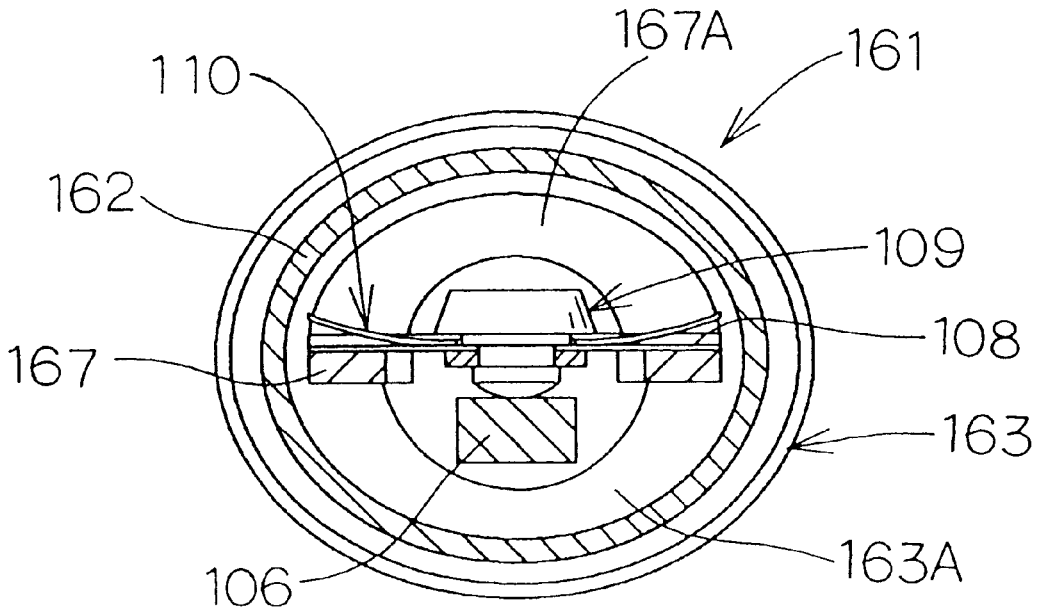
FIG. 16 is a view similar to FIG. 9, showing the thermally responsive switch of a seventh embodiment in accordance with the present invention.

Although the housing of the thermally responsive switch is cylindrical and has one closed end in each of the foregoing embodiments, the housing should not be limited to the cylindrical shape. The housing may have a section other than the circular one. For example, the housing 162 of the thermally responsive switch 161 has an elliptic section as shown as a seventh embodiment in FIG. 16.

The thermally responsive switch 161 will be described. The identical or similar parts in the switch 161 are labeled by the same reference symbols as in the above-described switch 101 and the description of these parts will be eliminated. The metal plate 163A of the header plate 163 secured to the open end of the housing 162 is also formed into an elliptic shape according to the elliptic section of the housing 162. The fixed end 167A of the movable plate support 167 secured to the metal plate 163A has a reduced height along the inner peripheral surface of the housing 162. The other construction of the thermally responsive switch 161 is the same as the above-described switch 101.

The distance between the inner peripheral surface of the housing 162 and the thermally responsive element 110 is rendered smaller when the housing 162 has the elliptic section than when the housing has a circular section as in each of the foregoing embodiments. As a result, the element 110 has an improved thermal responsiveness to the change in the ambient temperature. Furthermore, the thermally responsive switch 161 can be mounted on a heat-generating element more easily. Additionally, even after the housing 162 has airtightly been closed, the direction of the thermally responsive element 110 can be confirmed on the basis of the shape of the housing. Consequently, the thermally responsive switch can easily be mounted so that the thermally responsive element 110 faces the heat-generating element, and accordingly, the thermal responsiveness can further be improved.

The through holes of the movable plate and the thermally responsive element are circular in the foregoing embodiments. The shaft of the movable contact inserted through these holes is also circular in the foregoing embodiments. However, these holes and shaft should not be limited to the circular shape. For example, the holes and the shaft may be elliptic or polygonal. In this case, too, the same effect can be achieved.

The foregoing description and drawings are merely illustrative of the principles of the present invention and are not to be construed in a limiting sense. Various changes and modifications will become apparent to those of ordinary skill in the art. All such changes and modifications are seen to fall within the scope of the present invention as defined by the appended claims.

We claim:

1. A thermally responsive switch comprising:

a housing made of a metal into the shape of a bottomed cylinder and having an open end;

a header plate including a metal plate having a through hole and an electrically conductive lead terminal pin inserted through and airtightly fixed in the hole in an electrically insulated state, the header plate being airtightly fixed to the open end of the housing by means of welding or the like so that the housing and the header plate constitute a hermetic housing;

a thermally responsive element formed into the shape of a shallow dish and having a generally central through hole, the thermally responsive element reversing a curvature thereof in response to a first predetermined temperature and re-reversing the curvature in response to a second predetermined temperature;

a fixed contact section provided on a portion of the lead terminal pin located in the hermetic housing;

a rigid movable plate support secured to the metal plate of the header plate in the hermetic housing;

a flexible movable plate formed of a leaf spring-shaped conductive metal plate and having one end secured to the movable plate support, the movable plate exerting a biasing force normally pressing the other end thereof against the movable plate support side; and a movable contact fixed to said other end side of the movable plate, the movable contact engaging and disengaging from the fixed contact section when the thermally responsive element drives the movable plate.

2. A thermally responsive switch according to claim 1, wherein the thermally responsive element is connected to said other end side of the movable plate at a location of the through hole so as to be loosely fitted therewith, thereby being held.

3. A thermally responsive switch according to claim 2, wherein said one end of the movable plate is welded to the movable plate support, and the movable plate has a through hole formed in said other end side thereof, the through hole having a smaller diameter than the through hole of the thermally responsive element; wherein the movable contact has one end serving as a larger diameter portion and the other end serving as a smaller diameter portion, and a thermally responsive element loosely fitting section is provided between the larger and smaller diameter portions, the loosely fitting section having a such diameter as to be allowed to be inserted through the hole of the thermally responsive element and disallowed to be inserted through the hole of the movable plate; and wherein the smaller diameter portion of the movable contact is inserted through the holes of the thermally responsive element and the movable plate and a distal end of the smaller diameter portion of the movable contact having passed through the movable plate is deformed so that the movable plate is held by an end face of the loosely fitting section to thereby be fixed in position and so that the thermally responsive element is loosely fitted with the loosely fitting section of the movable contact to be thereby held in position.

4. A thermally responsive switch according to claim 2, wherein said one end of the movable plate is welded to the movable plate support, and the movable plate has a through hole formed in said other end side thereof and having a smaller diameter than the through hole of the thermally responsive element; wherein the movable contact includes a contact member and a thermally responsive element loosely fitting member having a loosely fitting section; wherein the contact member has one end serving as a contact portion; and wherein the loosely fitting section of the thermally responsive element loosely fitting member is inserted through the hole of the thermally responsive element and thereafter, the contact member having passed through the hole of the movable plate and the thermally responsive element loosely fitting member are welded together so that the movable contact is held around a welded portion thereof by the movable plate to be thereby fixed in position and so that the thermally responsive element is loosely fitted with the loosely fitting section of the movable contact to be thereby held in position.

5. A thermally responsive switch according to claim 2, which further comprises a thermally responsive element loosely fitting member discrete from the movable contact, and wherein the thermally responsive element loosely fitting member has one end serving as a larger diameter portion and the other end serving as a thermally responsive element loosely fitting section inserted through the hole of the thermally responsive element; wherein the movable contact is directly welded to the movable plate, the thermally responsive element loosely fitting section is inserted through the hole of the thermally responsive element, and a distal end of the thermally responsive element loosely fitting section is welded to a backside of the movable plate, so that the thermally responsive element is connected to and loosely fitted with the movable plate to thereby be held in position.

6. A thermally responsive switch according to claim 2, wherein the movable plate has a through hole formed in said other end side thereof and having a smaller diameter than the through hole of the thermally responsive element; wherein the movable contact has one end serving as a larger diameter portion and the other end serving as a smaller diameter portion, and a thermally responsive element loosely fitting section is provided between the larger and smaller diameter portions, the loosely fitting section having a such diameter as to be allowed to be inserted through the hole of the thermally responsive element and disallowed to be inserted through the hole of the movable plate; and wherein the movable contact is inserted through the holes of the thermally responsive element and the movable plate, the movable plate is welded to an end face of the thermally responsive element loosely fitting section to thereby be fixed in position, and the thermally responsive element is loosely fitted with the thermally responsive element loosely fitting section to thereby be held in position.

7. A thermally responsive switch according to claim 3, which further comprises a reinforcing plate having a through hole, and wherein the smaller diameter portion of the movable contact is inserted through the through hole of the reinforcing plate when being inserted through the holes of the thermally responsive element and the movable plate, and wherein the movable contact having passed through the movable plate is fixed to an end face of the thermally responsive element loosely fitting section through the hole of the reinforcing plate.

8. A thermally responsive switch according to claim 6, which further comprises a reinforcing plate having a through hole, and wherein the smaller diameter portion of the movable contact is inserted through the through hole of the reinforcing plate when being inserted through the holes of the thermally responsive element and the movable plate, and wherein the movable contact having passed through the hole of the movable plate is further inserted through the hole of the reinforcing member and fixed to an end face of the thermally responsive element loosely fitting section by crimping or the like.

9. A thermally responsive switch according to claim 1, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

10. A thermally responsive switch according to claim 2, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

11. A thermally responsive switch according to claim 3, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

12. A thermally responsive switch according to claim 4, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

13. A thermally responsive switch according to claim 5, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

14. A thermally responsive switch according to claim 6, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

15. A thermally responsive switch according to claim 7, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

16. A thermally responsive switch according to claim 8, wherein the movable plate includes a wear plate welded to a portion thereof fixed to the movable plate support for preventing deformation of a portion thereof around the fixed portion, the wear plate being welded to the fixed portion so as to hold the movable plate between itself and the movable plate support.

17. A thermally responsive switch according to claim 2, which further comprises a positioning member interposed between the movable plate support to which the movable plate is secured and the fixed contact section, the positioning member determining a positional relation between the movable contact and the fixed contact section.

18. A thermally responsive switch according to claim 3, which further comprises a positioning member interposed between the movable plate support to which the movable plate is secured and the fixed contact section, the positioning member determining a positional relation between the movable contact and the fixed contact section.

19. A thermally responsive switch comprising:

a housing made of a metal into the shape of a bottomed cylinder and having an open end;

a header plate including a metal plate having a through hole and an electrically conductive lead terminal pin inserted through and airtightly fixed in the hole in an electrically insulated state, the header plate being airtightly fixed to the open end of the housing by means of welding or the like so that the housing and the header plate constitute a hermetic housing;

a fixed contact provided on a portion of the lead terminal pin located in the hermetic housing;

a movable plate support secured to the metal plate of the header plate located in the hermetic housing;

a movable plate having elasticity and having one end secured to the movable plate support and a movable contact at the side of a movable contact, the movable plate exerting a biasing force normally pressing the other end thereof against the movable plate support side; and a thermally responsive element reversing a curvature thereof in response to a first predetermined temperature and re-reversing the curvature in response to a second predetermined temperature, the thermally responsive element driving the movable plate so that the movable contact engages and disengages from the fixed contact; and wherein the movable plate support, the movable plate and the thermally responsive element are integrally assembled to the header plate.

20. A thermally responsive switch according to claim 19, wherein the thermally responsive element is formed into the shape of a shallow dish and has a generally central through hole, the thermally responsive element being connected to said other end side of the movable plate at a location of the through hole so as to be loosely fitted therewith, thereby being held.

* * * * *

UNITED STATES PATENT AND TRADEMARK OFFICE

CERTIFICATE OF CORRECTION

PATENT NO. : 5,939,970

DATED : August 17, 1999

INVENTOR(S) : Takao Tsuji, et al.

It is certified that error appears in the above-identified patent and that said Letters Patent is hereby corrected as shown below:

On the title page, insert Item [30]:

[30] Foreign Application Priority Data

| | | |
|---|---|---|
| November 6, 1997 | [JP]Japan | 9-322244 |
| September 14, 1998 | [JP]Japan | 10-279470 |

Signed and Sealed this

Fifth Day of December, 2000

*Attest:*

Q. TODD DICKINSON

*Attesting Officer*

*Director of Patents and Trademarks*